United States Patent [19]

Mori

[11] Patent Number: 4,638,114

[45] Date of Patent: Jan. 20, 1987

[54] SHIELDED ELECTRIC WIRES

[75] Inventor: Akinori Mori, Tochigi, Japan

[73] Assignee: Sumitomo Electric Industries, Ltd., Osaka, Japan

[21] Appl. No.: 744,995

[22] Filed: Jun. 17, 1985

[30] Foreign Application Priority Data

Jun. 19, 1984 [JP] Japan ..... 59-92291[U]

[51] Int. Cl.[4] ..... H01B 7/34

[52] U.S. Cl. ..... 174/36; 174/108; 333/243

[58] Field of Search ..... 174/36, 108, 110 F; 333/243

[56] References Cited

U.S. PATENT DOCUMENTS

| | | | |
|---|---|---|---|
| 3,867,565 | 2/1975 | Prentice et al. | 174/36 X |
| 3,968,463 | 7/1976 | Boysen | 333/243 |
| 4,408,089 | 10/1983 | Nixon | 174/108 X |

FOREIGN PATENT DOCUMENTS

| | | | |
|---|---|---|---|
| 269534 | 2/1965 | Australia | 174/108 |
| 666810 | 9/1964 | Italy | 174/36 |
| 12622 | 12/1965 | Japan | 174/36 |

*Primary Examiner*—Arthur T. Grimley
*Assistant Examiner*—Morris H. Nimmo
*Attorney, Agent, or Firm*—Cushman, Darby & Cushman

[57] ABSTRACT

A shielded electric wire having an electric conductor, a high expansion insulating layer provided on the electric conductor, a rigid skin layer on the insulating layer, and a closed shield layer on the skin layer. The closed shield layer is produced by winding a number of electric wires on the insulating layer at a winding angle of 80°–85° from the normal to the longitudinal axis of the conductor. This electric wire is free from changes in its characteristics even if the degree of expansion of the insulating layer is as high as 65% or more and thus is suitable for use in wiring electronic devices such as computers.

7 Claims, 4 Drawing Figures

SHIELDED ELECTRIC WIRES

BACKGROUND OF THE INVENTION

1. Field of the Invention

The present invention relates to shielded electric wires, and more particularly, to improvements in shielded electric wires, such as coaxial cables, etc., to be used in wiring electronic devices such as computers.

2. Description of the Prior Art

With the advent of large-sized computers and increased computer speeds, it has become desirable to increase the speed at which signals are transmitted over coaxial cables used in computer systems.

Transmission speeds, defined in terms of propagation delay time, should be 3.9 nsec/m or less and should preferably be 3.7 nsec/m or less. The propagation delay time is determined as a function of the dielectric constant of the insulating material for the coaxial cable and its thickness. When the insulating material is polyethylene or polypropylene, it must be expanded (by foaming) as high as 65% and 80%, respectively, to obtain the desired transmission speed. Such a high degree of expansion can be produced by extrusion expansion of polyethylene or polypropylene with a rigid skin layer provided on the outer periphery thereof.

In order to decrease the outer diameter of the coaxial cable, it is desirable to apply a closed shield by winding a number of fine electrically conductive wires on the outer periphery of the insulating layer. During the process of applying the closed shield, the insulating layer is pressed by the electrically conductive wires, resulting in a decrease in the degree of expansion of the insulating layer. This greatly increases the dielectric constant of the insulating layer, particularly with high expansion insulating layers.

Accordingly, even if a high expansion insulating layer is provided, the ultimate coaxial cable does not have the desired dielectric constant.

SUMMARY OF THE INVENTION

As a result of extensive investigations to overcome the above problem, it has been found that the above-mentioned change in characteristics of the insulating layer during the process of applying the closed shield can be minimized by winding the fine electrically conductive wires on the insulating layer at a specific winding angle. According to the present invention, a shielded electric wire has an electrical conductor. A high expansion insulating layer having a degree of expansion of at least 65% is provided on the electrical conductor. A closed shield layer is provided on the insulating layer. The closed shield layer is produced by winding a number of electrical conductors on the insulating layer at a winding angle of 80°–85°. By using this range of winding angles, the resulting wire does not exhibit changes in characteristics even when the insulating layer is expanded by a large degree.

A rigid skin may be provided on the insulating layer, next to the shield layer.

BRIEF DESCRIPTION OF THE DRAWINGS

These and other objects and advantages of this invention will become more apparent and more readily appreciated from the following detailed description of the presently preferred exemplary embodiments of this invention, taken in conjunction with the accompanying drawings, of which.

DETAILED DESCRIPTION OF THE PRESENTLY PREFERRED EXAMPLARY EMBODIMENTS

Figure 1:
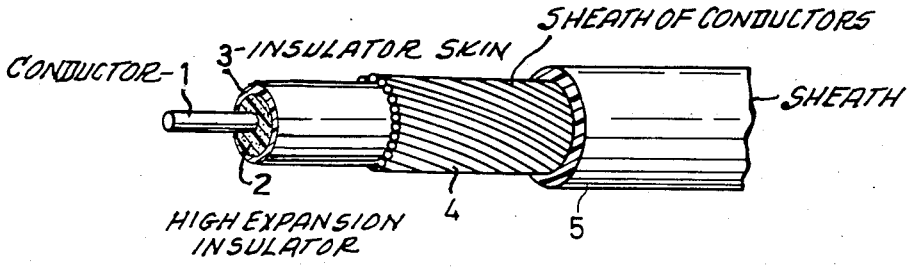
FIG. 1 is a perspective view illustrating the layers of the shielded electric wire of the present invention.

Referring to FIG. 1, a shielded electric wire of the present invention includes an electric conductor 1 made of a soft copper wire, a tin-plated soft copper wire, a silver-plated soft copper wire, or twisted strands thereof. A high expansion insulating layer 2 having a degree of expansion of at least 65%, as produced by extrusion expansion of a plastic, such as polyethylene or polypropylene, for example, surrounds electric conductor 1. A rigid skin layer 3 made of the same material as insulating layer 2 is provided on insulating layer 2. A shield layer 4 surrounds skin 3. Finally a sheath 5 made of polyvinyl chloride or polyethylene, for example, provides an outer covering.

Figure 2:
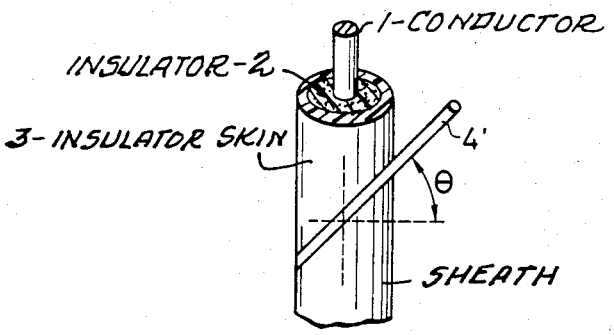
FIG. 2 is a schematic illustration view showing a winding angle at which the electrical wires are wound on the insulating layer.

Shield layer 4 is produced by winding a number of the soft copper wires, tin-plated soft copper wires, or silver-plated soft copper wires at a winding angle, $\theta$, of 80°–85°. FIG. 2 illustrates that angle $\theta$ is measured from the normal to the longitudinal axis of the wire.

Closed, shielded electric wires have heretofore been used in wiring for audio devices, for example. In these electric wires, the degree of expansion of the insulating layer has been as low as 50% or less. When the degree of expansion is 50% or less, even if the fine wires of the shield are wound at a commonly used winding angle of 65°–75°, for example, undesirable changes in dielectric characteristics for practical use do not occur. However, in high expansion insulating layers having a degree of expansion of 65% or more, if the soft copper wires of the shield are wound at a winding angle of 65°–75°, the dielectric characteristics are seriously changed by the force exerted on the insulating layer from the shield wires. Accordingly, when the degree of expansion is 65% or more, it is necessary to wind the wires of the shield at a winding angle of 80° or more. However, if the winding angle is in excess of 85°, the shield layer moves when the electric wire is bent, thereby allowing the insulating layer to be exposed more easily. Thus the winding angle is limited to 80°–85°.

The present invention is described in greater detail with reference to the following example.

EXAMPLE (1) Test for Determination of Winding Angle

A shielded electric wire having the following structure was produced. An electric conductor 1 in the form of a soft copper wire, 0.203 mm in diameter, was covered with an insulating layer 2 having an outer diameter of 0.80 mm and a degree of expansion of 40–80%. Insulating layer 2 was provided with a rigid skin layer 3 when the degree of expansion was 65% or more. Closed, shield layer 4 was produced by winding 33 tin-plated soft copper wires having a diameter of 0.08 mm about insulating layer 2.

Changes in the dielectric characteristics of the wire were determined by calculating the electrostatic capacity (C) by the following equation:

$$C(PF/m) = \frac{24.12 \times \epsilon}{\log(d_2/d_1)}$$

where:

$d_1$=diameter of the electric conductor;

$d_2$=outer diameter of the insulating layer; and $\epsilon$=dielectric constant of the insulating material.

Figure 3:
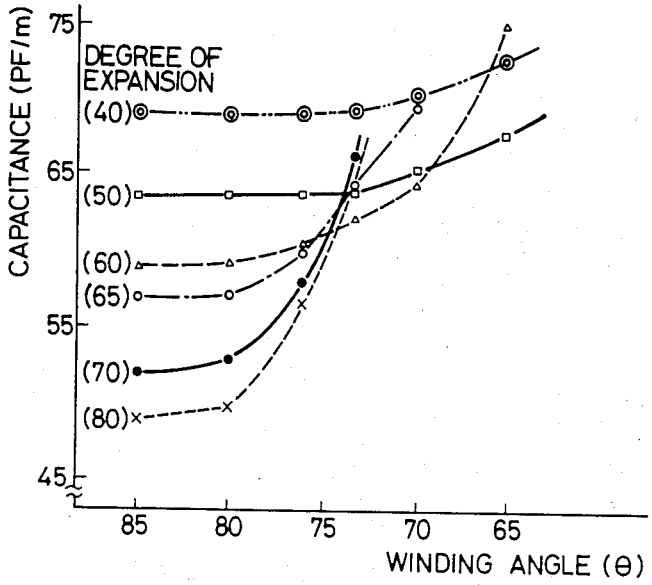
FIG. 3 is a graph showing the relation between the winding angle and capacitance when the wire tension is 40 g.
Figure 4:
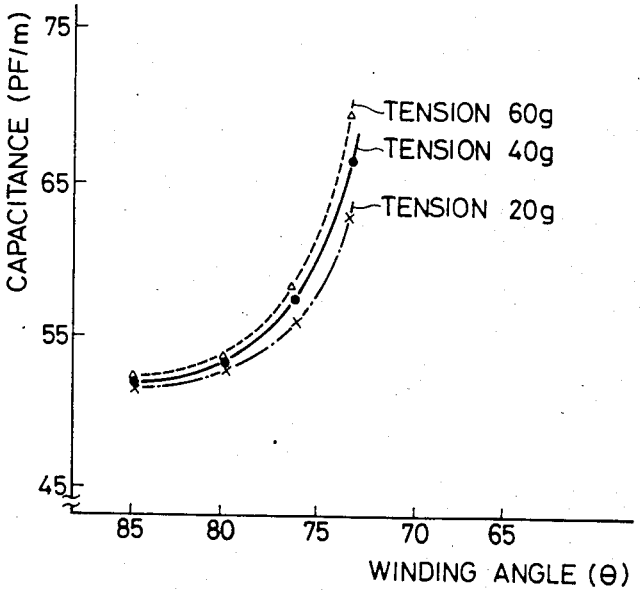
FIG. 4 is a graph showing the relation between the winding angle and capacitance when the degree of expansion is 70% and the wire tension is 20–60 g.

FIG. 3 shows the relation between the winding angle ($\theta$) and capacitance (C) when the electric wire is wound at a tension of 40 g. FIG. 4 shows the relation between the winding angle ($\theta$) and capacitance (C) when the electric wire is wound at a tension of 20–60 g on the insulating layer having a degree of expansion of 70%.

It can be seen that when the degree of expansion of the insulating layer is 50% or less, even if the electric wire is wound at a winding angle of 65°–75° C., no significant changes in characteristics for practical use are observed.

When the degree of expansion is 65% or more, the characteristics deteriorate unless the winding angle is adjusted to 80° or more. When the winding angle is 80° or more, variations in capacitance are very small even if the tension is changed.

(2) Characteristics of Coaxial Cable

Structure of Electric Wire

A coaxial cable was constructed with an electric conductor 1 being tin-plated soft copper wire having a diameter of 0.203 mm. Surrounding conductor 1 was insulating layer 2 having an outer diameter of 0.75 mm and a degree of expansion of 80%. Skin 3 was provided on insulating layer 2. Closed, shield layer 4 was produced by winding 30 tin-plated soft copper having a diameter of 0.08 mm at a winding angle of 80° on skin 3. Sheath 5, made of polyvinyl chloride and having an outer diameter of 1.20 mm, covered shield layer 4.

Characteristics

Characteristic impedance: 76 Ω (measured by TDR)

Propagation delay time: 3.7 nsec/m (measured by TDR)

Electrostatic capacity: 53 PF/m (10 kHz)

In the shielded electric wire of the present invention, even if the insulating layer has a degree of expansion as high as 65% or more, the force exerted on the insulating layer by the shield layer is decreased by choosing the winding angle within the range of 80° to 85° for the wires of the shield layer. Thus, in the process of applying the closed, shield layer, an increase in the dielectric constant can be minimized, and the characteristics of the insulating layer can be maintained.

Although only several exemplary embodiments of this invention have been described in detail above, those skilled in the art will readily appreciate that many additional modifications may be made within the spirit and teachings of this invention. Accordingly all such modifications are intended to be included within the scope of this invention as defined by the following claims.

What is claimed is:

1. A shielded electric wire comprising:

an electric conductor having a longitudinal axis;

a high expansion insulating layer having a degree of expansion of at least 65% provided around said conductor; and closed shield layer means, surrounding said insulating layer, for shielding said insulating layer and said conductor without compressing said insulating layer and without hindering an expansion thereof, said shield layer means including a plurality of electrically conducting wires wound around said insulating layer at a winding angle of 80°–85° to a perpendicular to said longitudinal axis of said conductor.

2. A shielded electric wire as in claim 1 further comprising a skin layer surrounding said insulating layer, adjacent said shield layer means.

3. A shielded electric wire as in claim 2 wherein said skin layer is made of the same material as said insulating layer.

4. A shielded electric wire as in claim 1 wherein said conductor is at least one selected from the group consisting of copper, tin-plated copper, and silver-plated copper.

5. A shielded electric wire as in claim 1 wherein said insulating layer is plastic.

6. A shielded electric wire as in claim 5 wherein said plastic is at least one selected from the group consisting of polyethylene and polypropylene.

7. A shielded electric wire as in claim 1 wherein said plurality of electrically conducting wires is made of at least one selected from the group consisting of copper wires, tin-plated copper wires and silver-plated copper wires.

* * * * *